US010973353B2

(12) United States Patent
Parvarandeh

(10) Patent No.: US 10,973,353 B2
(45) Date of Patent: Apr. 13, 2021

(54) DETACHABLE COMPARTMENT FOR IN-HOME DELIVERY

(71) Applicant: i.Clarity LLC, Los Altos, CA (US)

(72) Inventor: Pirooz Parvarandeh, Palo Alto, CA (US)

(73) Assignee: i.Clarity Innovations LLC, Los Altos, CA (US)

( * ) Notice: Subject to any disclaimer, the term of this patent is extended or adjusted under 35 U.S.C. 154(b) by 47 days.

(21) Appl. No.: 16/208,266

(22) Filed: Dec. 3, 2018

(65) Prior Publication Data

US 2020/0170432 A1 Jun. 4, 2020

(51) Int. Cl.

| | |
|---|---|
| ***E06B 3/32*** | (2006.01) |
| ***A47G 29/20*** | (2006.01) |
| ***E05B 65/06*** | (2006.01) |
| ***E06B 7/28*** | (2006.01) |

(52) U.S. Cl.
CPC ..... *A47G 29/20* (2013.01); *E05B 65/06* (2013.01); *E06B 7/28* (2013.01)

(58) Field of Classification Search
CPC ..... A47G 29/20; E05B 65/06; E05B 7/28
USPC ..... 160/127, 92, 94, 95, 96, 97, 107
See application file for complete search history.

(56) References Cited

U.S. PATENT DOCUMENTS 1,204,833 A * 11/1916 Warfel ..... E06B 9/52 160/97
1,479,312 A * 1/1924 O'Harrow ..... E06B 9/0638 160/97
2,455,112 A * 11/1948 Christison ..... E06B 9/063 160/32
3,378,950 A * 4/1968 Butler ..... E06B 7/28 49/70
4,103,458 A * 8/1978 Booker ..... E06B 7/28 160/114
5,660,144 A * 8/1997 Venti ..... A01K 1/035 119/416

(Continued)

FOREIGN PATENT DOCUMENTS

DE 102016113778 B3 * 11/2017 ..... A47G 29/20

*Primary Examiner* — Jerry E Redman
(74) *Attorney, Agent, or Firm* — Robert S. Babayi; Vector IP Law Group PLLC

(57) ABSTRACT

An entry device that is attachable to a door that pivots relative to a door frame to separate an outer area from an inner area is disclosed. The device has a compartment made of a flexible material having a first side and a second side. The flexible material has a front surface that faces the outer area and a back surface that extends into the inner area. At least one first attachment point is disposed along the first side that attaches the compartment to the door and at least one second attachment point is disposed along the second side that attaches the compartment to the door frame. According to the present invention, upon opening of the door, the compartment is configured to allow partial entry of an object to the inner area and prevent full entry by a person from the outer area. A first lock disposed along the first side configured to lock the door, wherein the first lock can be unlocked from the inner area and outer areas and a second lock disposed along the second side configured to lock the door frame, wherein the second lock can be unlocked from the inner area and outer areas.

12 Claims, 20 Drawing Sheets

(56) References Cited

U.S. PATENT DOCUMENTS

| | | | | |
|---|---|---|---|---|
| 6,089,302 | A * | 7/2000 | Britt | E06B 9/08 160/28 |
| 6,123,321 | A * | 9/2000 | Miller | A47D 13/065 160/135 |
| 6,164,013 | A * | 12/2000 | Ramsey | E06B 7/28 49/169 |
| 6,357,509 | B1 * | 3/2002 | Lamazares | E05C 17/00 160/210 |
| 6,550,828 | B2 * | 4/2003 | Warden | E05C 17/54 292/262 |
| 7,165,595 | B2 * | 1/2007 | Yamamoto | E05F 11/54 160/97 |
| 9,307,741 | B1 * | 4/2016 | McNee | E06B 7/28 |
| 9,388,631 | B2 * | 7/2016 | Woeltjen, Jr. | E06B 7/32 |
| D811,668 | S * | 2/2018 | Peavy | D30/199 |
| 10,221,618 | B2 * | 3/2019 | Pedersen | E05B 65/0014 |
| 10,435,942 | B1 * | 10/2019 | Dunavin | E06B 3/7009 |
| 2005/0173078 | A1 * | 8/2005 | Perez, Jr. | A01K 3/00 160/99 |
| 2011/0023365 | A1 * | 2/2011 | Kilfoyle | E06B 7/32 49/70 |
| 2020/0170434 | A1 * | 6/2020 | Lemieux | A47G 29/20 |

* cited by examiner

DETACHABLE COMPARTMENT FOR IN-HOME DELIVERY

BACKGROUND

FIG. 1 shows top view of a door 11 and a door-frame 12. FIG. 2 shows the door 11, a door Hinge 13 and axis of rotation of the door used for delivery of an object 14 from outside to inside within positions for package placement by a delivery person 16. As the door opens, the delivery person 16 can for example leave a package 17 inside the home and leave or he can proceed to walk into the home when he is not supposed to.

The notion of letting a stranger into one's home is a relatively new idea and requires the customers for these services to get very comfortable with this notion. Services of in home delivery of goods have appeared in the marketplace. Some of these services rely on a camera system to monitor the proper delivery of goods into the home when the occupant is not present. The service providers also do background checks on the individuals who sign up to do these deliveries. In the future, there may be incidents where a bad actor can create a bad perception about the reliability and safety of these kinds of services. It further requires that the perceived benefits need to outweigh the risks.

DETAILED DESCRIPTION OF THE INVENTION

Figure 1:
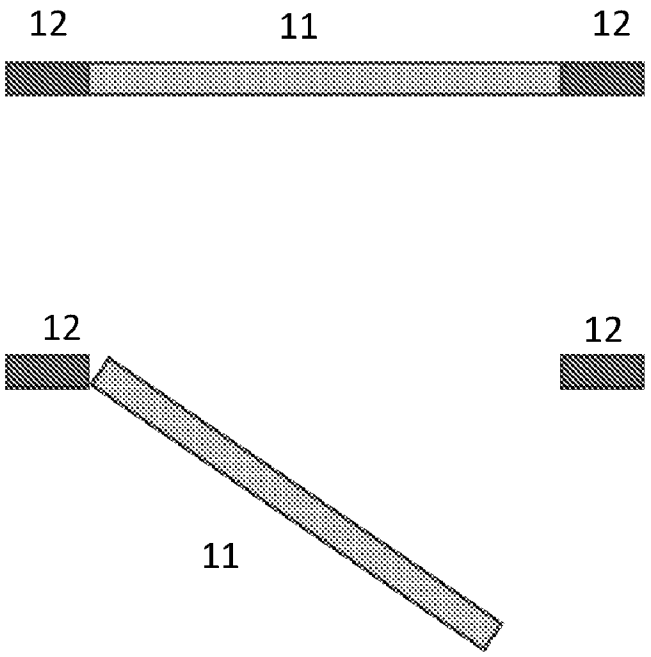
FIG. 1 shows top view of a door and a door-frame.
Figure 2:
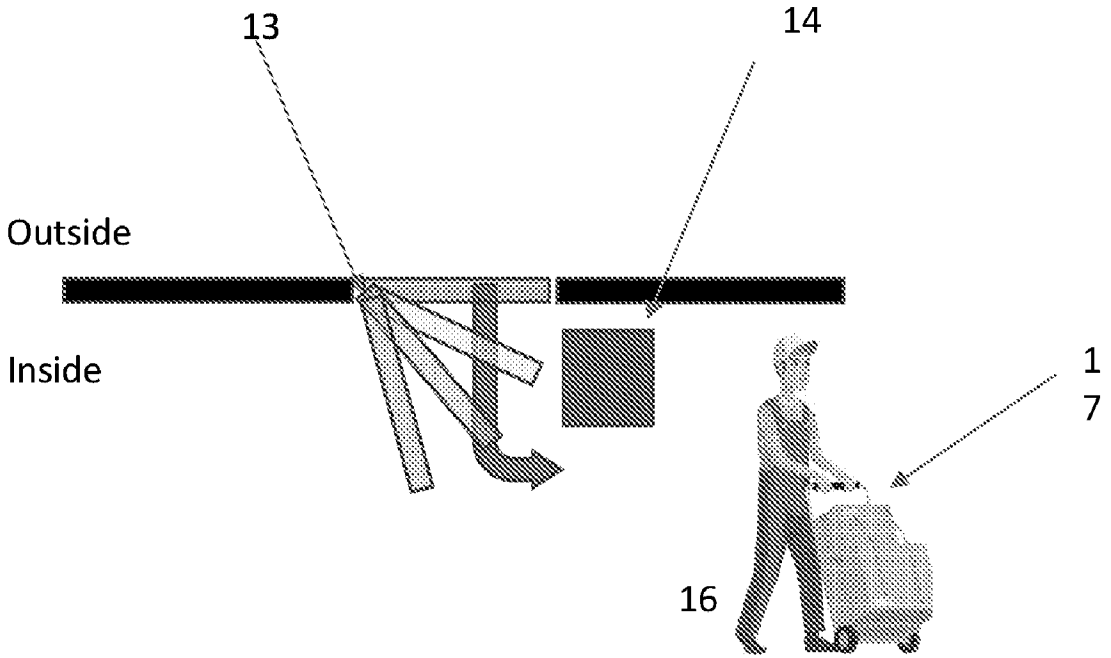
FIG. 2 shows door positions for package placement by a delivery person.

The present invention is an entry device attachable to a door 11 that pivots relative to a door frame 12 to separate an outer area from an inner area. The device has a compartment made of a flexible material having a first side and a second side. The flexible material has a front surface that faces the outer area and a back surface that faces the inner area. At least one first attachment point is disposed along the first side that attaches the compartment to the door and at least one second attachment point is disposed along the second side that attaches the compartment to the door frame. According to the present invention, upon opening of the door, the compartment is configured to allow partial entry of an object to the inner area and prevent full entry by a person from the outer area. A first lock disposed along the first side configured to lock the door, wherein the first lock can be unlocked from the inner area and outer areas and a second lock disposed along the second side configured to lock the door frame, wherein the second lock can be unlocked from the inner area and outer areas.

Advantages of the invention are:

In home delivery services can perform their services as before. Instead of entering the house, a delivery person can place the delivered item in a compartment that isolates the inside of the house from the outside.

The advantages provided are higher security—no physical intrusion into the home

The delivery person cannot see inside the house. In home deliveries can be made while the occupant is in the home but does not want to come to the door.

The need for a monitoring camera that is placed inside the house is eliminated. This is because there are concerns about the privacy of the home-owner when an internet connected camera is monitoring the inside of the house during a delivery process. There are further concerns about privacy even when a delivery is not being made.

A security camera can be provided that only monitors the compartment area.

Homes that have pets can ensure that the pets do not leave the premises when a delivery is being made.

When delivery of pharmaceutical products are made, one can ensure that non-authorized individuals cannot get access to these drugs.

The following definitions apply to the elements of the claimed invention and the description of acronyms used in the Figs.:

Definitions

| Acronym | Full Name | Object, Signal, Sensor, Processor | Function |
|---|---|---|---|
| FAPU | Frame - Attach - Panel - Upper | Obj | Connection point attached to the door frame (upper) - Provides an anchor point to attach the compartment to the frame. |
| FAPM | Frame - Attach - Panel - Middle | Obj | Connection point attached to the door frame (middle) |

-continued

| Acronym | Full Name | Object, Signal, Sensor, Processor | Function |
|---|---|---|---|
| FAPL | Frame Attach - Panel - Lower | Obj | Connection point attached to the door frame (lower) |
| DAPU | Door - Attach - Panel - Upper | Obj | Connection point attached to the door (upper) - Provides an anchor point to attach the compartment to the door. |
| DAPM | Door - Attach - Panel - Middle | Obj | Connection point attached to the door (middle) |
| DAPL | Door - Attach - Panel - Lower | Obj | Connection point attached to the door (lower) |
| VRB | Vertical Rigid Bars | Obj | Each side of the compartments is equipped with a rigid bar that is vertical. On the Frame side, the rigid bar "slips into" the FAPU and FAPL. This rigid bar is then locked to FAPM using a mechanical or electronic lock. On the Door side, the rigid bar "slips into" the DAPU and DAPL. This rigid bar is then locked to DAPM using a mechanical or electronic lock. There are a minimum of two vertical bars in the system that can be described. It is conceivable for there to be alternatives to the vertical bars to secure the compartment to the door frame and the door. VRB can be the generic term, but it is implicit that there is a VRB-1 and VRB-2. In the case of a Rigid Compartment (described below), the vertical bars are connected to an accordion door on the door side of the compartment. |
| LCD | Lock - Compartment - Door | Obj | Mechanical or electronic lock that locks DAPM and the rigid bar and DAPM together. The LCD has a proximity sensor that detects the detachment of the LCD from DAPM. The signal from this proximity sensor goes to the central unit. The ALARM condition occurs if the LCD is detached prior to informing the CU that the compartment is being unlocked. |
| LCDA | Lock - Compartment - Door - Alarm | Sig | LCD can detect it is being tampered with. If someone is forcibly trying to open this lock (without using the appropriate methods), then it sends a signal LCDA to the main controller. |
| LCF | Lock - Compartment - Frame | Obj | Mechanical or electronic lock that locks DAPM and the rigid bar and DAPM together. The LCF has a proximity sensor that detects the detachment of the LCF from FAPM. The signal from this proximity sensor goes to the central unit. The ALARM condition occurs if the LCF is detached prior to informing the CU that the compartment is being unlocked. |
| LCFA | Lock - Compartment - Frame - Alarm | Sig | LCF can detect it is being tampered with. If someone is forcibly trying to open this lock (without using the appropriate methods), then it sends a signal LCFA to the main controller. |
| Comp-R | Rigid Compartment | Obj | This is envisioned as a compartment with rigid walls on 3 sides + a rigid top + a rigid bottom piece. The outer sides of this compartment are connected to the vertical rigid bar. Two types of rigid compartments have been described in the drawings - Type 1 and Type 2. |
| Comp-P | Panel Based Compartment | Obj | This is composed of a number of vertical solid panels that are attached to each other, but whose collective shape can change depending on user preferences. See the drawing. This design allows foldability for easy storage. The "outer" panels are each connected to the vertical rigid bar. |
| Comp-C | Collapsible Compartment | Obj | This has the vertical rigid bars. It optionally has rigid bars in other places to give it form. Its outer wall is composed of a flexible/collapsible material similar to a large bag. This flexible material can be designed to act as a penetration barrier as well as a visual barrier. |
| AD | Accordion Door | Obj | In the case of Comp-R, there is an Accordion Door that moves with the door (to the extent the door opens). The Accordion door can span the entire front end of Comp-R when the door is closed and it can open to expose the full front of |

-continued

| Acronym | Full Name | Object, Signal, Sensor, Processor | Function |
|---|---|---|---|
| | | | Comp-R when the door is opened to the full extent that Comp-R allows the door to open. See drawings. |
| Code 1 | Electronic code to the entry door. | Sig | This code is used by the owner and other authorized personnel such as an apartment manager or the fire department. |
| Code 2 | Electronic code to the entry door - temporary | Sig | This code is sent to the delivery person. It has a time limit. It is temporary and changes after one time use. It has an expiration date from the time of issue. |
| DM | Main Door | Obj | Door to the entry of the house. Controlled by Code 1 or Code 2 |
| DMA | Main Door Alarm | Sig | When the main door is opened, there is a signal indicating that the door has opened. This is standard within a home security system. |
| Code 3 | Electronic code to detach the compartment from the door frame and the door. In some cases, the locks LCF and LCD may be mechanical in which case a code is not required. | Sig | This code is used by the owner or an authorized person to unlock the compartment from the door frame and door. Once unlocked, each of the vertical bars can be removed from FAPU, FAPL or DAPU, DAPL. |
| Code 4 | Electronic code that opens a pet door in the compartment. | Sig | The compartment is normally sealed from entry and exit for pets. A specific action or code is required in order to allow a pet in or out of the home. |
| DP | Pet Door | Obj | Door that allows access to pets inside the house. It is large enough for pets to fit through but small enough to prevent people from entering. It is controlled by Code 4. |
| DPA | Pet Door Alarm | Sig | DP can detect it is being tampered with. If someone is forcibly trying to open this lock (without using the appropriate methods), then it sends a signal DPA to the main controller. |
| Code 5 | Electronic code for delivery of medical or hazardous products. | Sig | We can have a locked compartment within the main compartment. This allows medication to be delivered to the home by placing it within this secondary compartment. Given that it has a unique code, it can not be accessible to children who might have access to the home (i.e. have Code 1, 2, 3, or 4). |
| CD | Compartment for Drugs | Obj | This compartment may be attached to or detached from the main compartment. It has its own lock that is controlled by Code 5. |
| CDA | Compartment for Drugs Alarm | Sig | CD can detect it is being tampered with. If someone is forcibly trying to open this lock (without using the appropriate methods), then it sends a signal CDA to the main controller. |
| PDM | Penetration - Detection - Mechanism | Sens | If any of the compartment types are physically breached (sawing through the rigid or panel types) or cutting through the collapsible type, this well be detected. The usual way to do this is to detect an open in a wire mesh that is normally shorted. Envision a single wire (PSW) that "covers" an area. Any breach that cuts this wire can be detected by a sensor. In the case of panel type compartments, one would need a dedicated PDM for each panel. We can call these PDM1-PDMn (for n-panels). Even for the other compartment types, we can use a multitude of PDMs (for ease of construction or for more security). |
| MPI | Mesh to prevent Physical Intrusion | Obj | This is a mesh of strong wires that can be difficult to cut though. It is envisioned for primary use in the Comp-C construction, but can also be used in the Comp-R and Comp-P constructions. |

-continued

| Acronym | Full Name | Object, Signal, Sensor, Processor | Function |
|---|---|---|---|
| PSW | Penetration Sensor Wire | Sens | A wire that is used to detect penetration of the barrier when it is cut. This can be a wire that can be "easy" to cut during a penetration attempt. When it opens up, the PDM is able to detect this. |
| VBDD | Vertical Bar Detachment Detection | Sens | The vertical bars are attached either to the frame or the door. The portion that connects or latches into the FAPU, FAPL, DAPU, DAPL is equipped with a proximity sensor such that when the vertical bar is moved away from its "latched" position, then the proximity sensors are triggered. The vertical bars have a "snap-on" capability such that they are held in place unless a force is applied to remove them. These proximity sensors can be implemented as magnetic sensors, acoustic sensors and in some cases electrical sensors. Given that there are 4 connection points of the vertical bars (FAPU, FAPL, DAPU, DAPL), we can get 4 signals for VBDD (one for each connection point). We can create acronyms such as VBDD-FAPU etc. |
| VBDD-A | Vertical Bar Detachment Detection Alarm | Sig | If a vertical bar is being detatched, a signal called VBDD-A is sent to the main controller. |
| VS | Vibration Sensor | Sens | Vibration sensors can be placed at various points on the compartments to detect unusual motions that might be associated with a break-in attempt. These vibration sensors are accelerometers. They can trigger if the vibrations exceed a certain magnitude, or have a predetermined set of signatures, or exceed certain durations of time. We can have a number of these sensors: VS-1 to VS-n. |
| VSA | Vibration Sensor Alarm | Sig | Signals VS-1 to VS-n are analyzed according to an algorithm. If an unacceptable vibration is detected that signals an intrusion attempt, the VSA signal is asserted. The analysis of these signals can be done in the main controller or they can be done outside of the main controller. |
| LTD | Lock tamper detect | Sig | LTD can be implemented for the main door, the locks LCD, LCF, |
| P2P-M | Panel to Panel Connectors - Mechanical | Obj | In the panel compartment type, there is a need to connect the panels to one another mechanically. This is in the form of a hinge that can be connected or disconnected when the owner is in the house. The connection or disconnection mechanism is not accessible to a person who is on the other side of the panel assembly. |
| P2P-E | Panel to Panel Connectors - Electrical | Obj | In the case of the panel compartment type, there is one configuration where an electrical connection between the panels allows system simplification. For example, each panel can be equipped with a PDM (Penetration Detection Mechanism). If we have an assembly of 9 panels, it is may not be economical to power each panel separately and to wirelessly transmit 9 separate PDM signals. In addition, one needs to route the outputs of the VS(s) and the VBDD-x to some central unit. Even though each of these signals can be transmitted in a wireless fashion to a central unit, it may be more economical to have a power bus that powers the various sensors and a data bus that aggregates the relevant sensor outputs. There are known ways to allow sensors to share a bus for data transmission. The combination of power and data requires either 3 busses or 4 busses depending on the desired protocol. This bus architecture also applies to the rigid compartment as well as the collapsible compartment types. Therefore, having a unified bus architecture allows a single design for the central unit that aggregates the various signals. The CU can also sense when one of these wires is cut. |

-continued

| Acronym | Full Name | Object, Signal, Sensor, Processor | Function |
|---|---|---|---|
| CU | Central Unit | Proc | This unit receives the various signals from the sensors. It can be programmed to send an alarm signal if certain conditions are met (based on the sensor outputs described above). The CU can then be tied into the central alarm system for the house (HCA) or it can send an ALERT to an internet connected device (home-owner or friend of a home-owner). The CU can be programmed to take pictures during a perceived intrusion (with a camera that is installed in the compartment or elsewhere). The CU can also issue verbal/audio WARNINGS. |
| Camera | | Sens | A camera can be installed to view the inside of the container. This allows viewing of the delivery person and the objects they have delivered. This camera can be attached to the container as opposed to being in the house. |
| HCA | House Central Alarm | Proc | See above. |
| ALERT | | Sig | See above. |
| WARNINGS | | Sig | See above. |

Figure 3B:
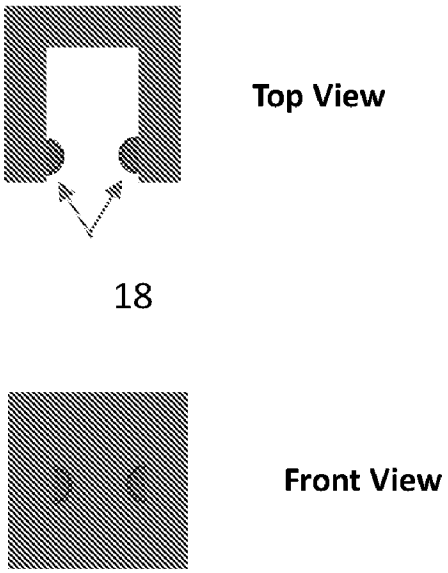
FIG. 3B shows top and front view of a connection/attachment point shown in FIG. 3A.
Figure 3A:
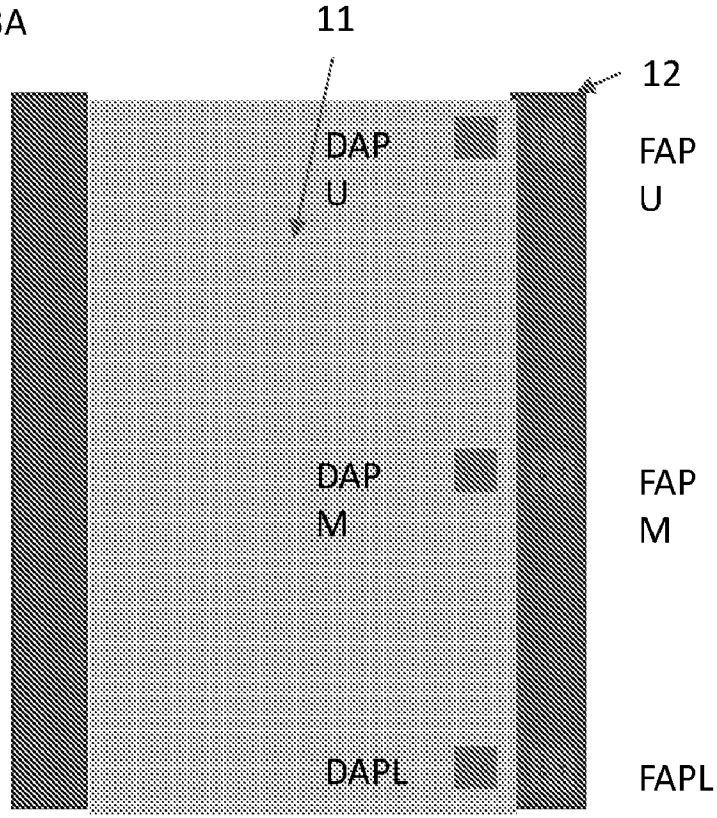
FIG. 3A shows a compartment with connection or attachment points that are not attached to the door frame according to a first embodiment of the invention referred to herein as compartment-pivot (Comp-P) embodiment.

FIG. 3A shows a compartment with connection/attachment points that are not attached to the door 11 frame according to a first embodiment of the invention referred to herein as compartment-pivot (Comp-P) embodiment. FIG. 3B shows top and front view of a connection/attachment point. In one implementation, the size of the connection/attachment point can be 1 inch per side which is shaped to allow insertion of a vertical rigid bar 20 (shown in FIG. 4) via dimples 18 that provide a snap on action.

Figure 4:
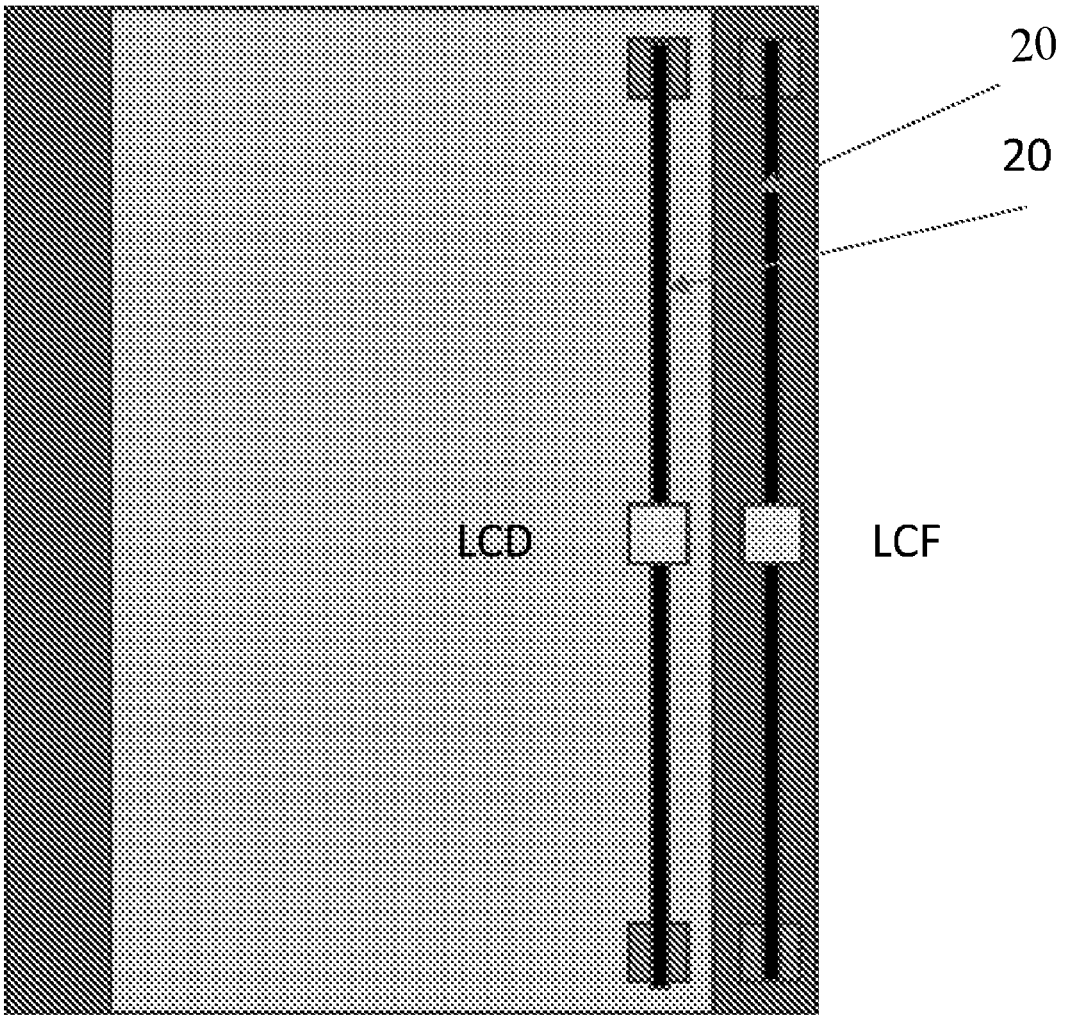
FIG. 4 shows a compartment with connection/attachment points of FIG. 3*b* secured by rigid pars.

FIG. 4 shows a compartment with connection/attachment points secured by rigid bars 20. As shown in FIG. 4, after the rigid bars 20 are snapped, the locks (LCD, LCF) are put in place.

Figure 5:
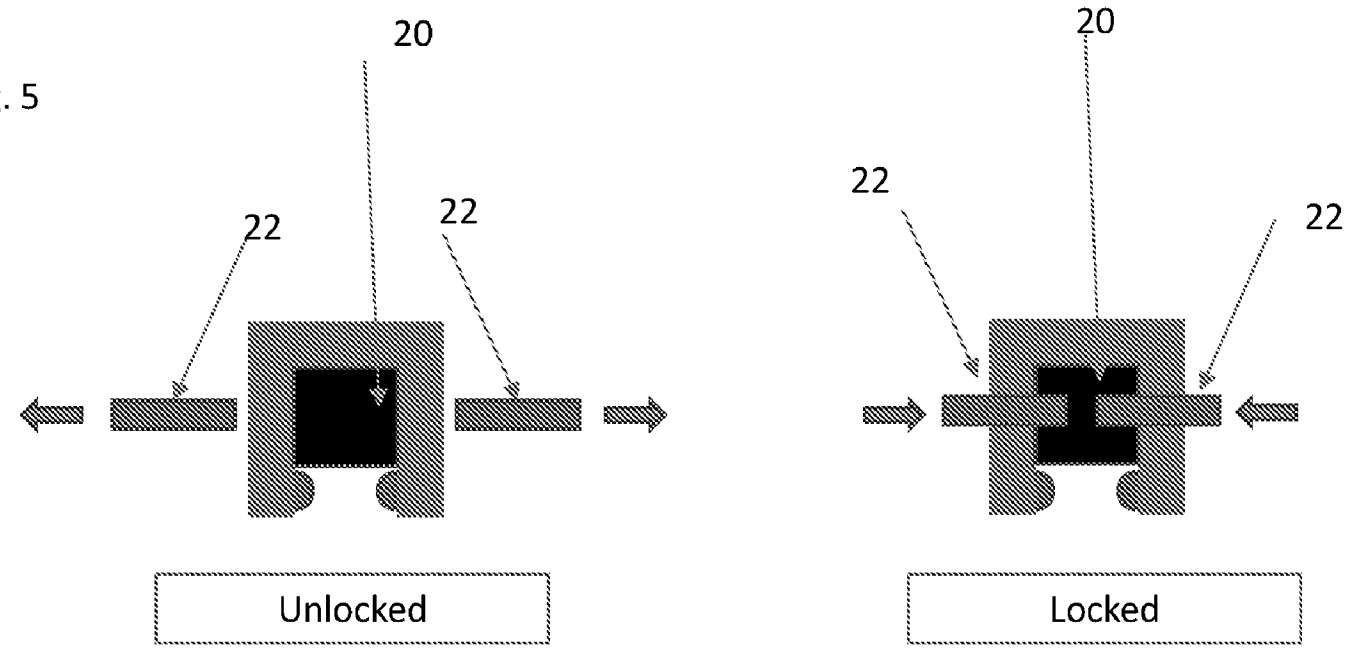
FIG. 5 shows a top view of a lock of FIG. 3A in locked and unlocked positions.

FIG. 5 shows a top view of a lock in locked and unlocked positions. As shown in FIG. 5, the locks LCD, LCF have a pin 22 or two pins 22 that insert laterally into holes on the sides of the FAPM and DAPM. The rigid bars 20 have aligning holes such that the pins can secure the rigid bar to the FAPM, DAPM. Given that the pins 22 are part of the LCF, LCD, the locked position can secure 3 components together: {FAPM, Rigid Bar 20, LCF} & {DAPM, Rigid Bar 20, LCD}. While two pins 22 are shown, one pin can be used to for locking and unlocking actions.

Figure 6:
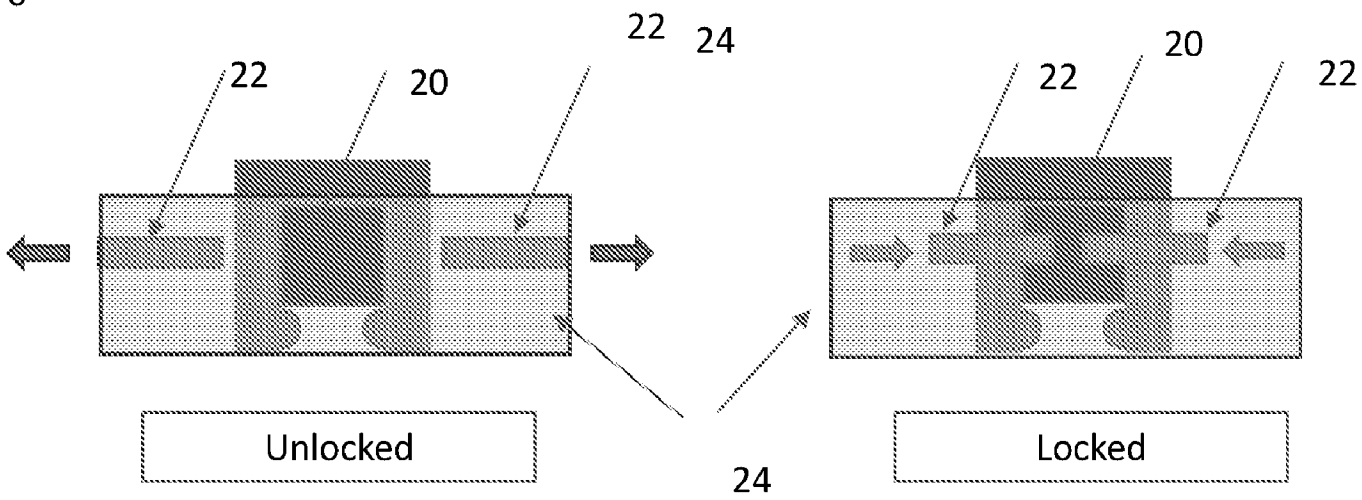
FIG. 6 shows top view of rigid bars, pins, FAPM/DAPM LCF/LCD in the locked and unlock position with lock enclosures of FIG. 5.

FIG. 6 shows top view rigid bars 20, pins 22, FAPM/DAPM LCF/LCD in the locked and unlock position with lock enclosures 24.

Figure 7:
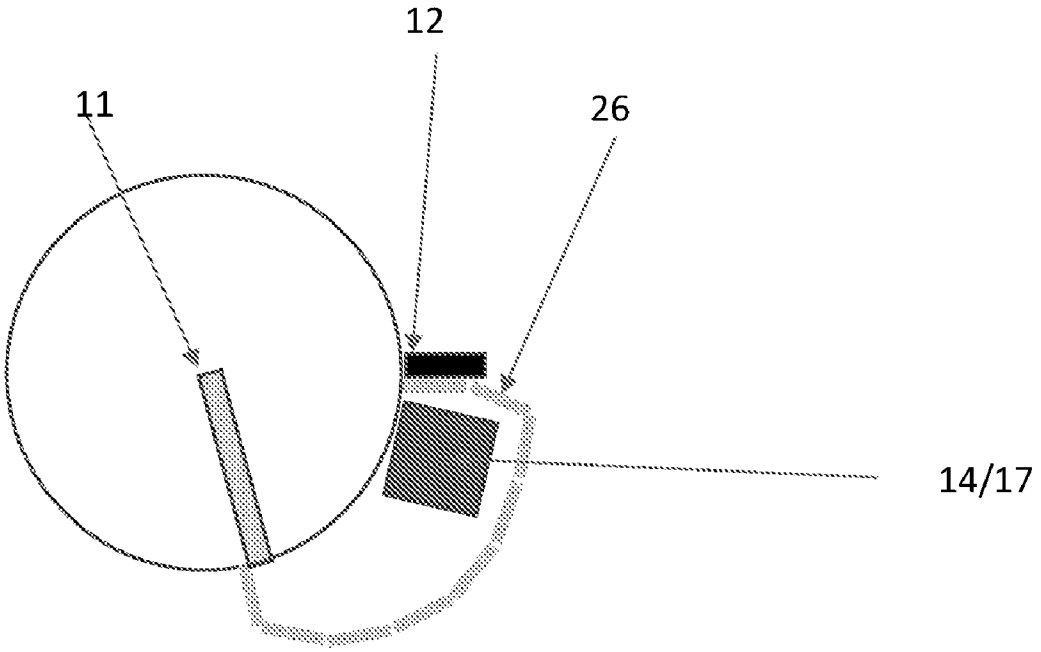
FIGS. 7-11 shows top view of shapes of the compartment of FIG. 3A at different open door positions.
Figure 8:
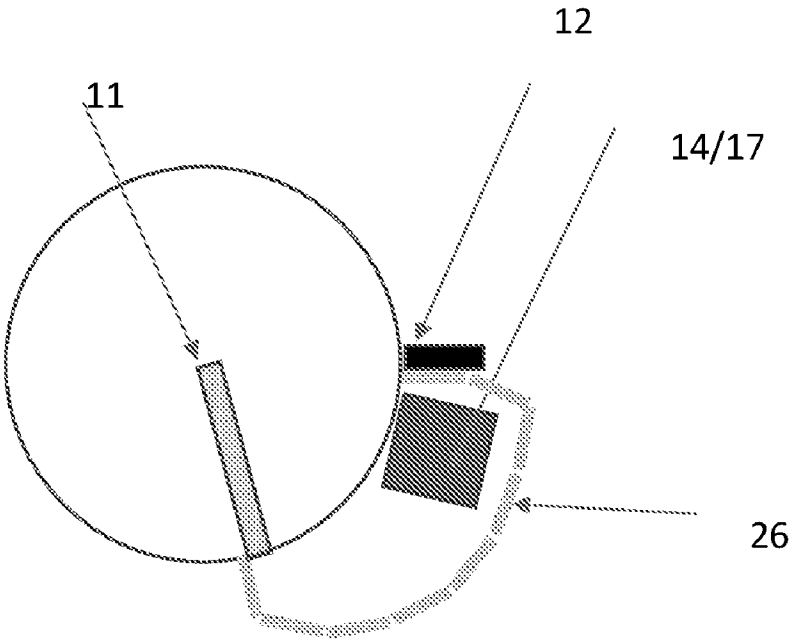
Figure 9:
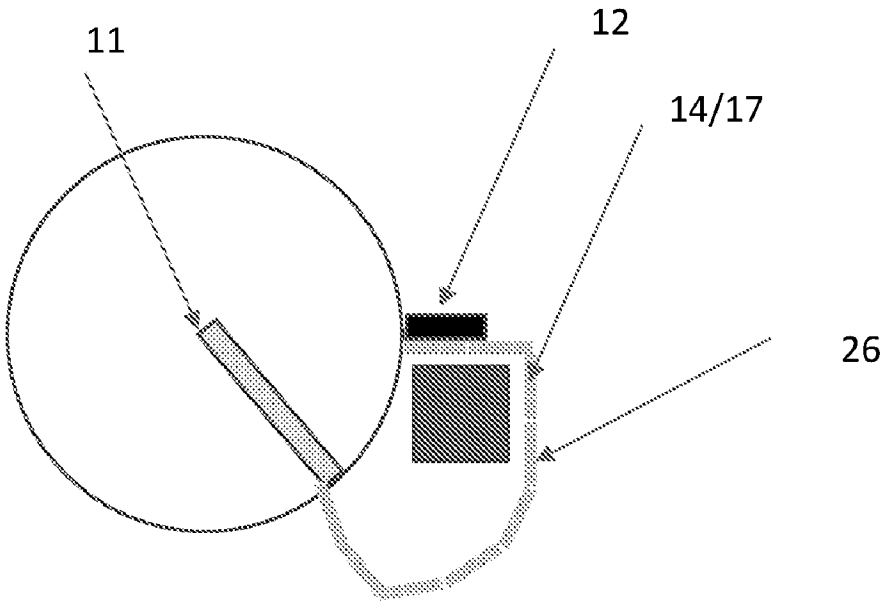
Figure 10:
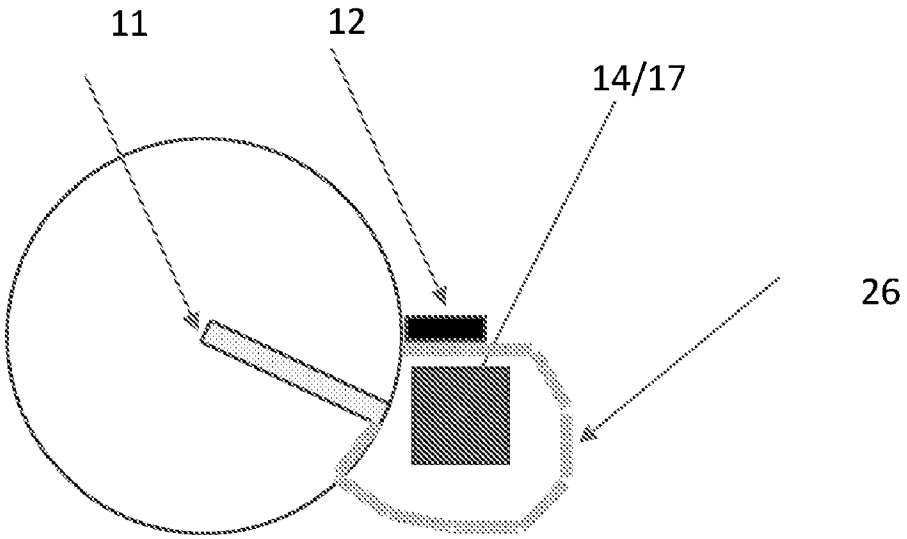
Figure 11:
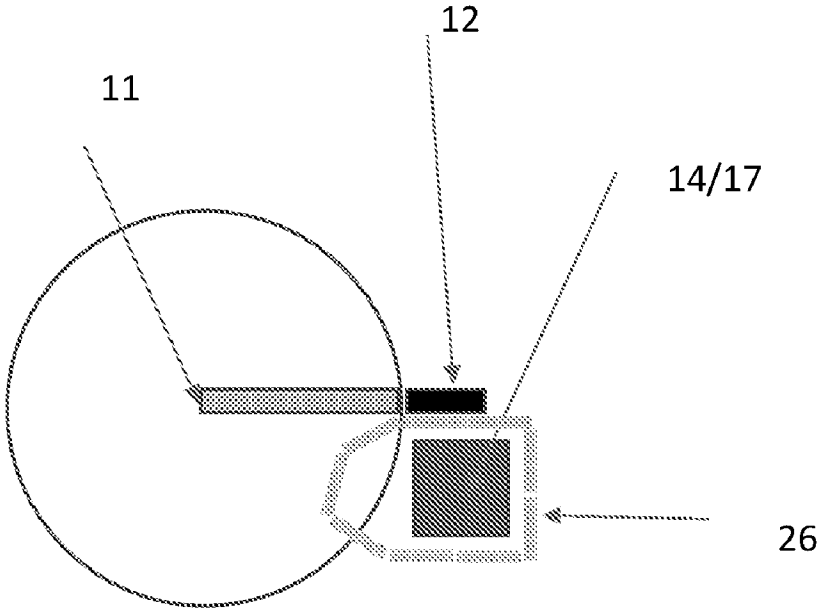

FIGS. 7-11 shows top view of shapes of the compartment at different open door positions. FIG. 7 shows a flexible compartment 26 attached to a door 11 with the door being fully opened via a door hinge around an axis of Rotation for placing a package/object 14/17 in a home. As shown, the compartment is made of 9 segments 28 that are linked together. FIG. 8-10 shows the flexible compartment 26 attached to the door 11 with the door being partially opened at different positions after the package is placed in the home. FIG. 11 shows the package 14/17 placed in the home with the door closed.

Figure 12:
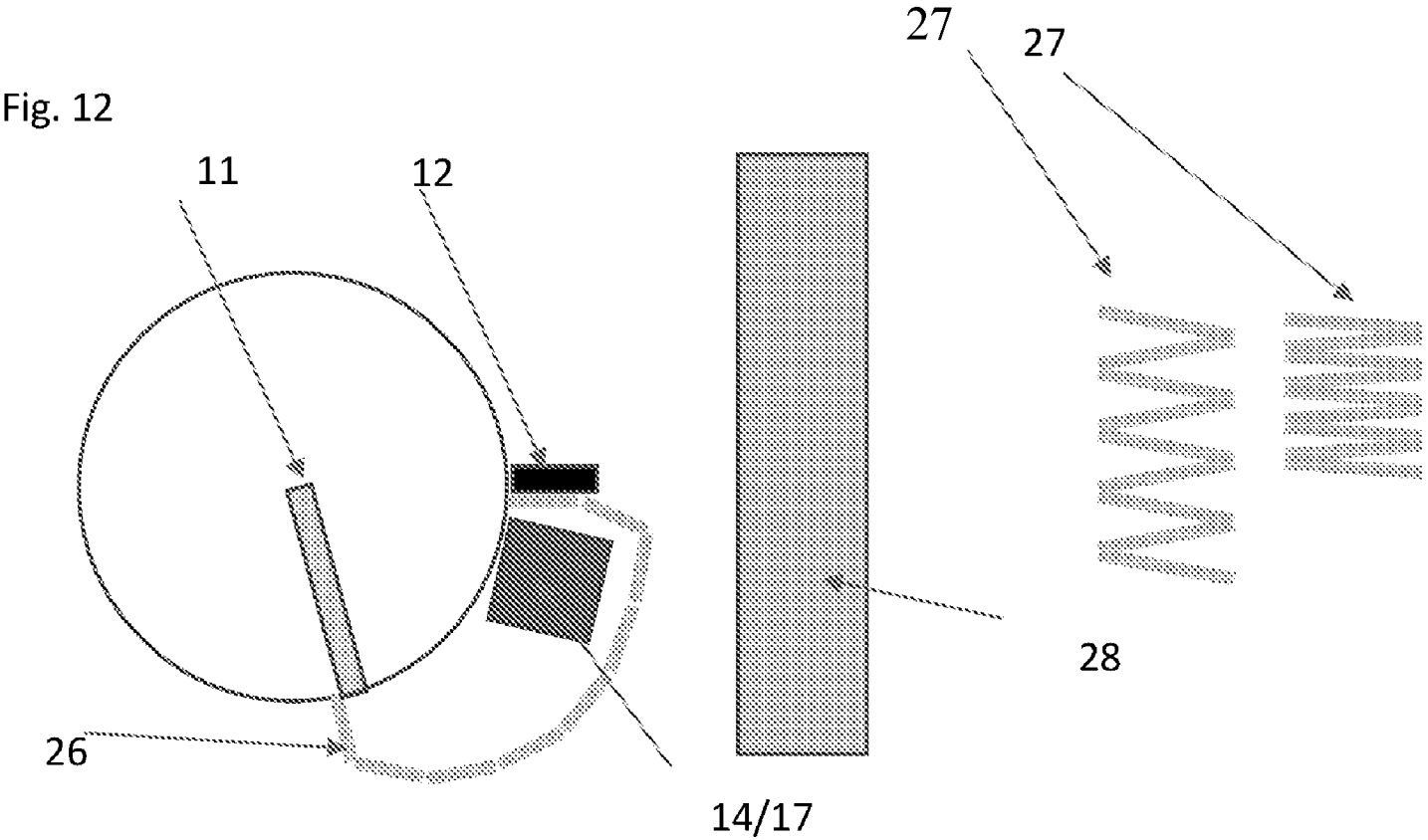
FIG. 12 shows the compartment of FIG. 3A as a foldable panel system.

FIG. 12 shows the compartment as a foldable panel system 27. In one example, the foldable panel system 27 has linked panels 28 that are 1.5 ft wide×7 ft tall. The linked panels 28 are joined to each other through hinges and can be folded for storage. Each panel can be solid to provide a physical barrier to entry.

Figure 13:
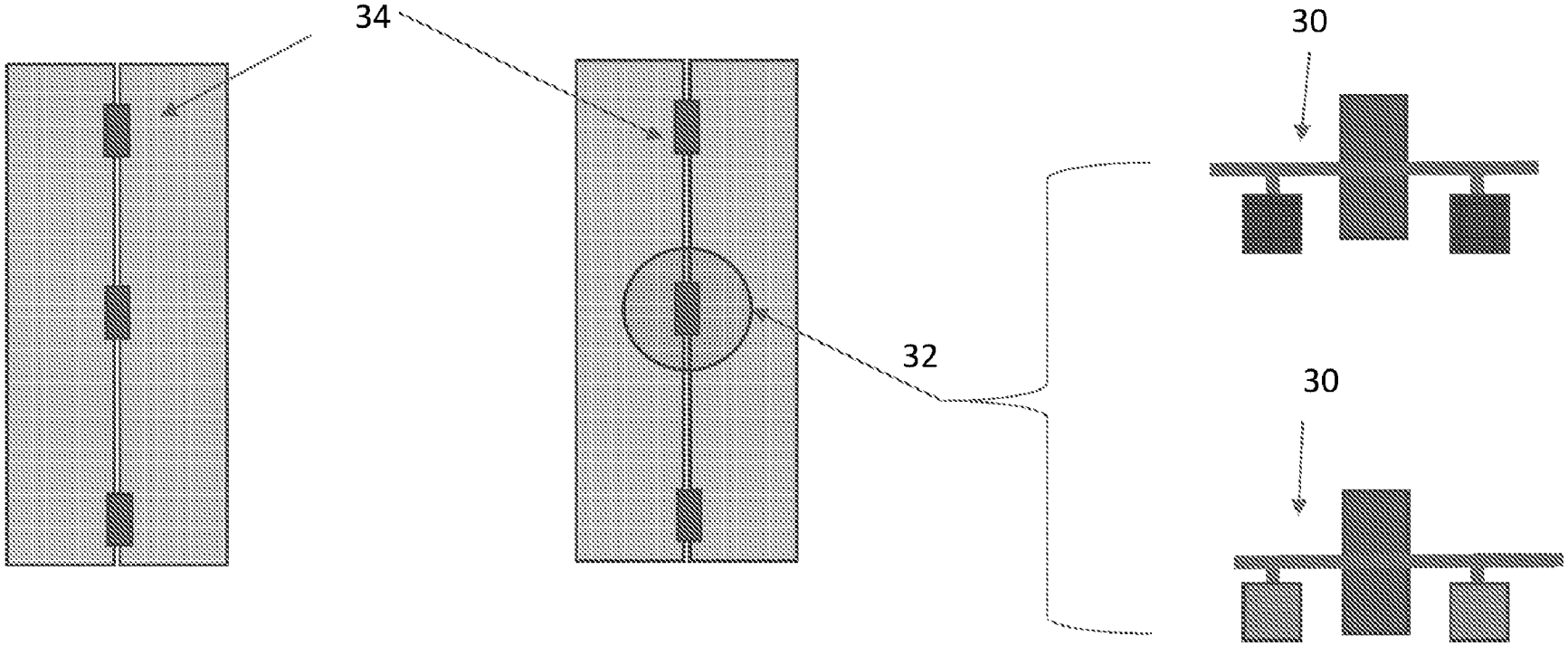
FIG. 13 shows an intrusion detection system for the compartment of FIG. 3A.

FIG. 13 shows an intrusion detection system 30 for the compartment of FIG. 3A The intrusion detection 30 system uses sensors 32 positioned on panel connections with hinge Connections 34 facing inside side of the compartment. Electrical connections between panels have wires for power, sensors, and RF communication modules shown. The intrusion sensors consist of the following:

1. Puncturing a panel—One can have a thin wire that spans the area of the panel such that if any part of the panel is broken into, the wire opens and interrupts current flow through it. The transition to an open state is detected and communicated to a central unit. A plurality of thin wires can also span the surface, each of which can have its own "open" wire detector mechanism.
2. Other sensor types such as accelerometers can be used to detect shaking of the panels. One can set an alarm if the shaking is larger than a certain threshold in magnitude and longer than another threshold in duration. This information is either sent to a central unit in raw form or as a processed signal.
3. The communications from the sensors can be through a wired connection or through wireless means.
4. A cut in the wiring across the panels can also be detected by the central unit. This sensing can be done by the central unit or distributed "open-wire" detectors can send this status to a central unit.

The last panel that connects to the door frame and the last panel that connects to the door can have intrusion sensors.

Figure 14:
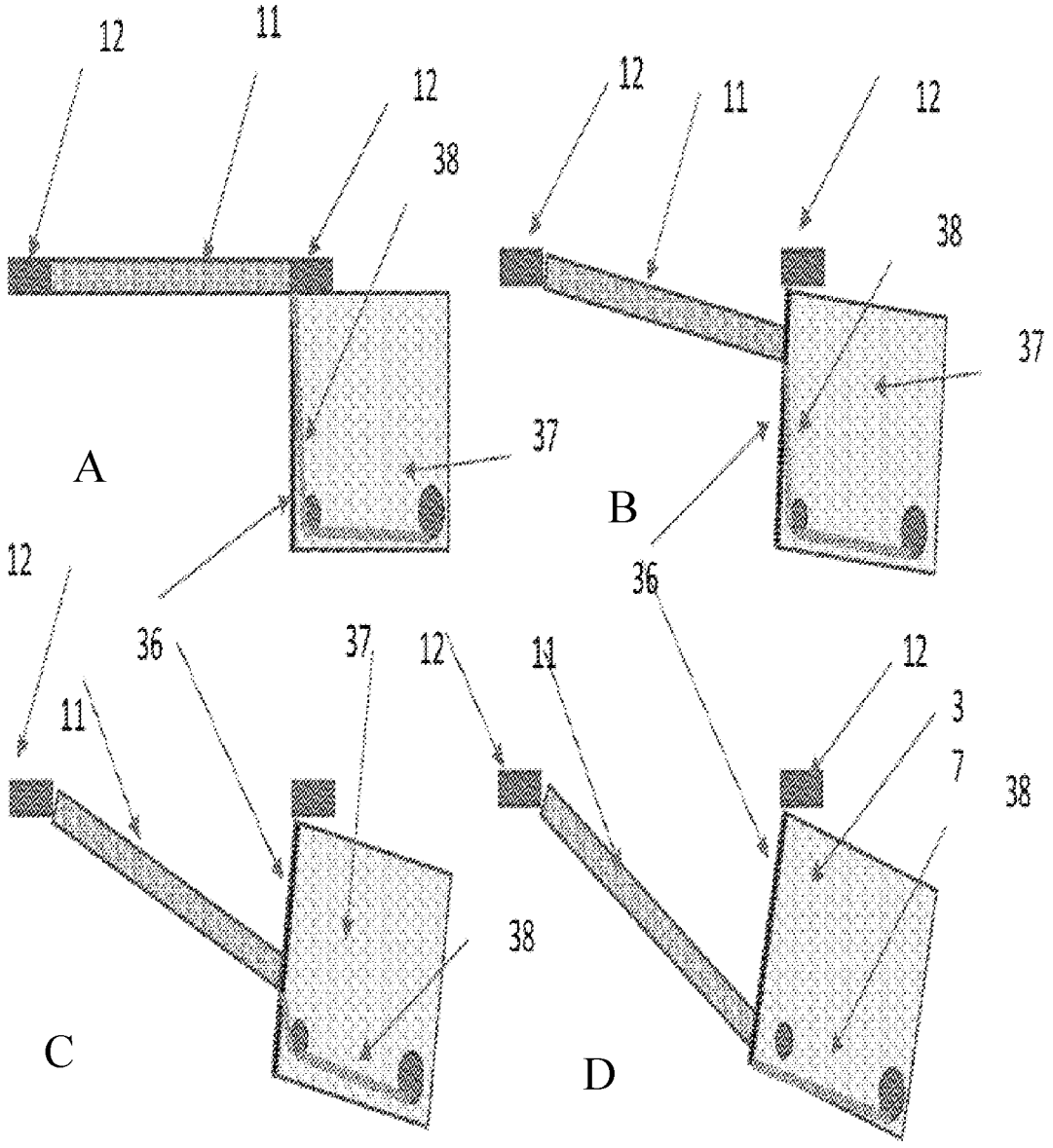
FIG. 14 shows a compartment according to one type of a second embodiment of the invention referred to herein as compartment-rail (Comp-R Type 1) embodiment in different door positions.
Figure 15:
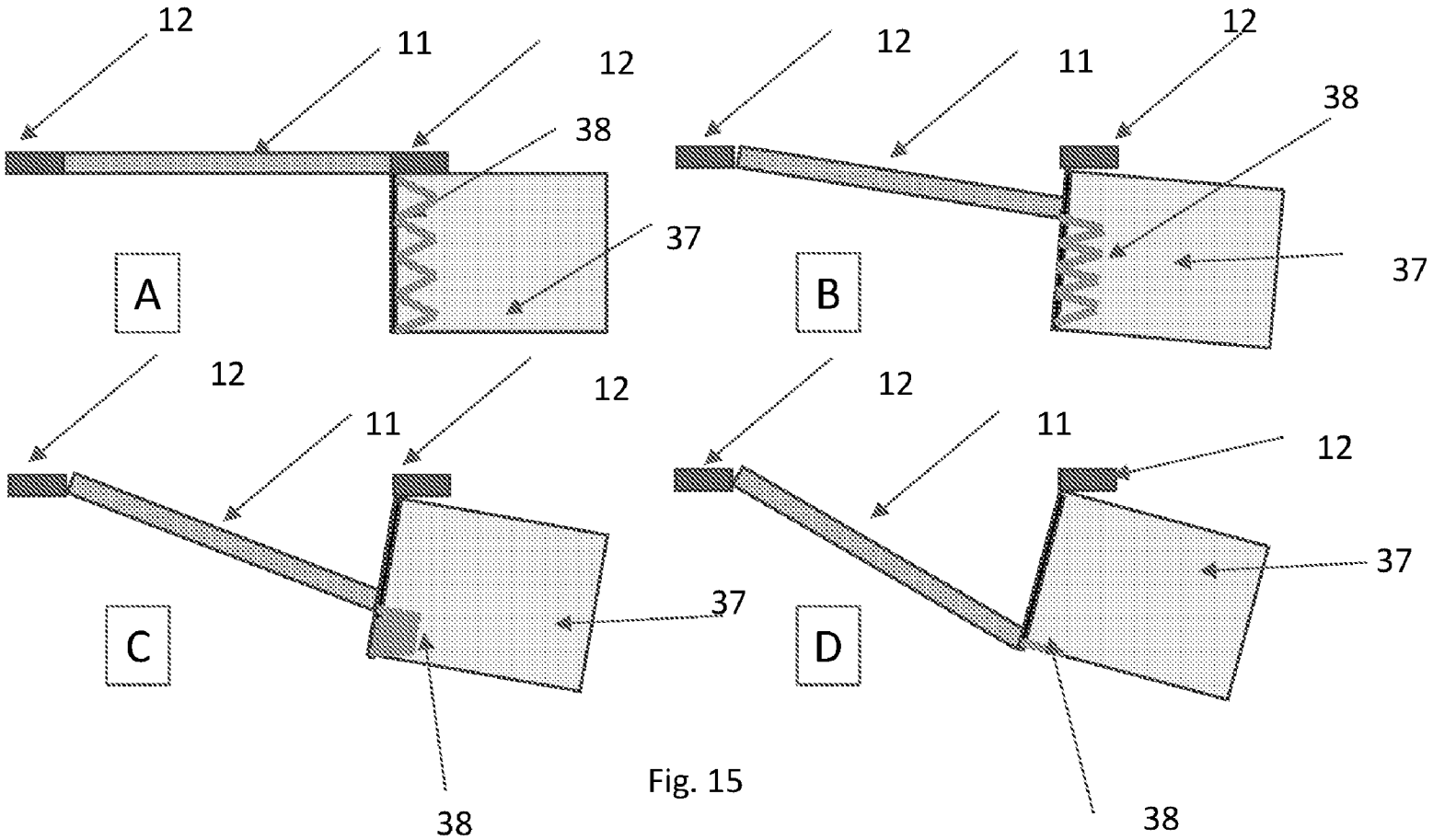
FIG. 15 shows the embodiment of FIG. 14 with an accordion door.

FIG. 14 shows a compartment according to one type of a second embodiment of the invention referred to herein as compartment-rail (Comp-R Type 1) embodiment in four different door positions. A straight railing 36 is used to allow the compartment 37 to rotate as the door is opened with an accordion door 38. The accordion door 38 is a folding door which opens by folding back in sections or so-called panels. FIG. 15 shows the embodiment of FIG. 14 with an accordion door 38.

Comp-R embodiment, Type 1 or 2, can have intrusion sensors that detect frame or door disruption. The section of the compartment that connects to the door and the one that connects to the frame can have intrusion sensors.

The proper procedure is to disable the alarm system before entering the home. The steps are as follows:

1—Informing the central unit that the compartment-frame and/or compartment-door can be detached.

2—If the detaching process is done through a physical key, then the above step is necessary.

3—If the detaching process is done through an electronic key, then the electronic key communicates to the central unit before opening the locks (LCF, LCD).

4—Once unlocked, the compartment can be removed from the Frame/Door and the occupant can enter the home.

5—Sensors can be present on LCF, LCD to detect a tamper event—where the locks are forced open in a manner that represents an intrusion.

Figure 16:
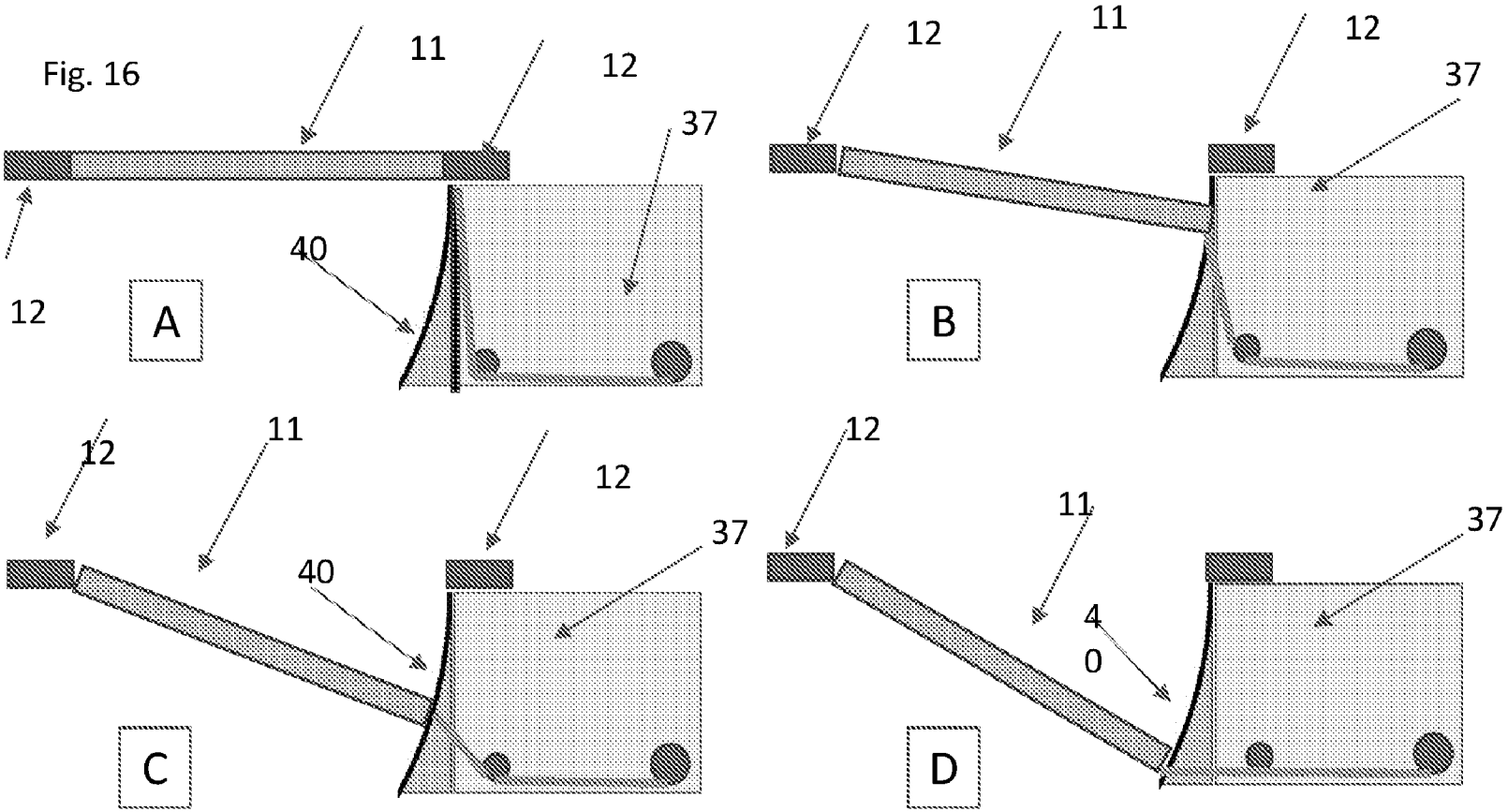
FIG. 16 shows a compartment according to another type of the second embodiment of the invention referred to herein as compartment-rail (Comp-R Type 2) embodiment in different door positions.
Figure 17:
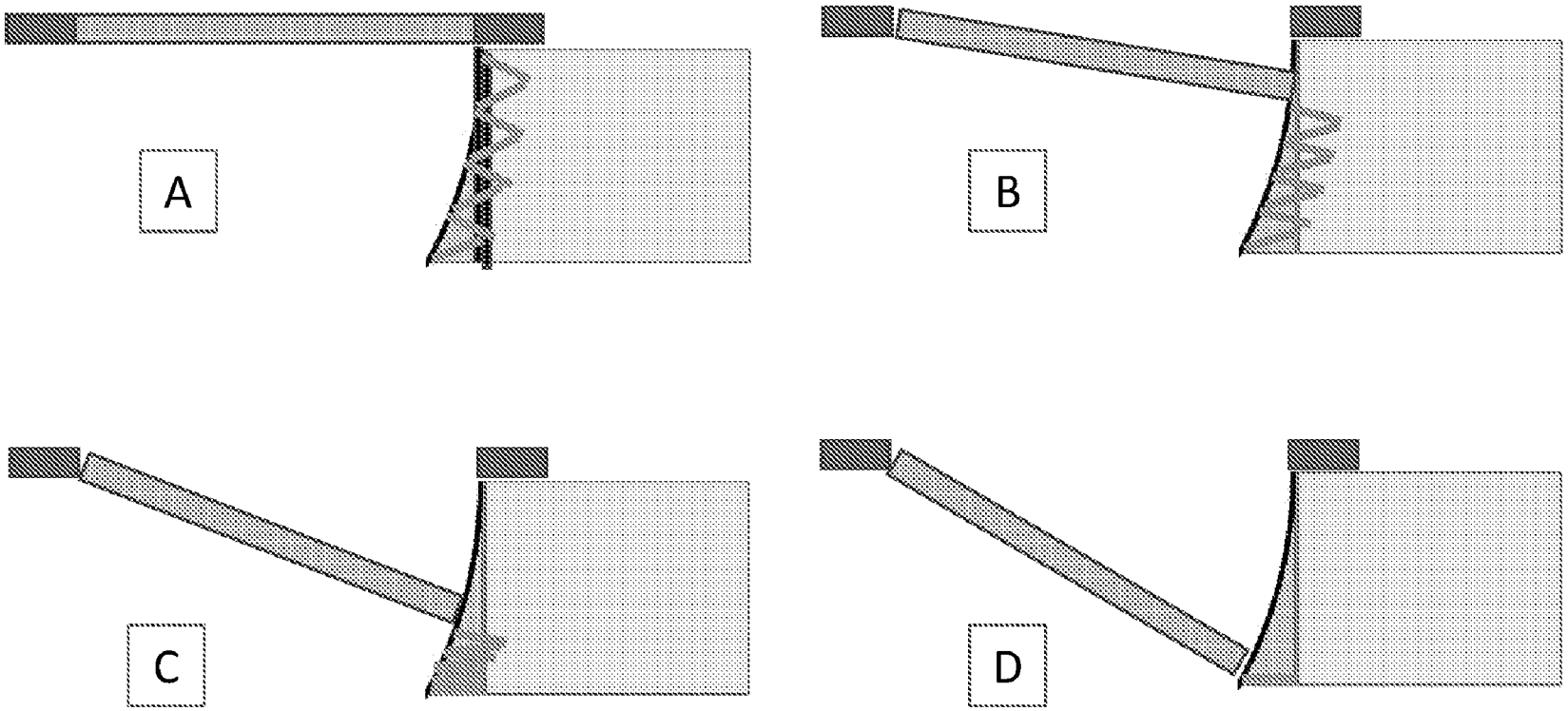
FIG. 17 shows the embodiment of FIG. 16 with an accordion door.

Different types of intrusion attempts can be detected:

1. Main Door—Part of a standard alarm system
2. Once the main door is opened, there are multiple ways to try to penetrate the container:
   a) Disconnecting the vertical bars from the door or the door frame
   b) Shaking of the vertical bars as a precursor to a physical attempt to disrupt the system
   c) Unauthorized unlocking of LCD or LCF or a tamper detection of LCD or LCF.
   d) Unauthorized opening of the pet door
   e) Unauthorized opening of the pharma container
   f) Penetration of the walls of the container (all three types)
   g) Delivery process takes longer than allowed
   h) Camera system detects unusual behavior FIG. 16 shows a compartment 37 according to one type of a second embodiment of the invention referred to herein as compartment-rail (Comp-R Type 2) embodiment in different door position. As shown, this embodiment uses a semi-circular arc 40 for railing with the gray showing a part of the compartment. FIG. 17 shows the embodiment of FIG. 16 with an accordion door.

Figure 18:
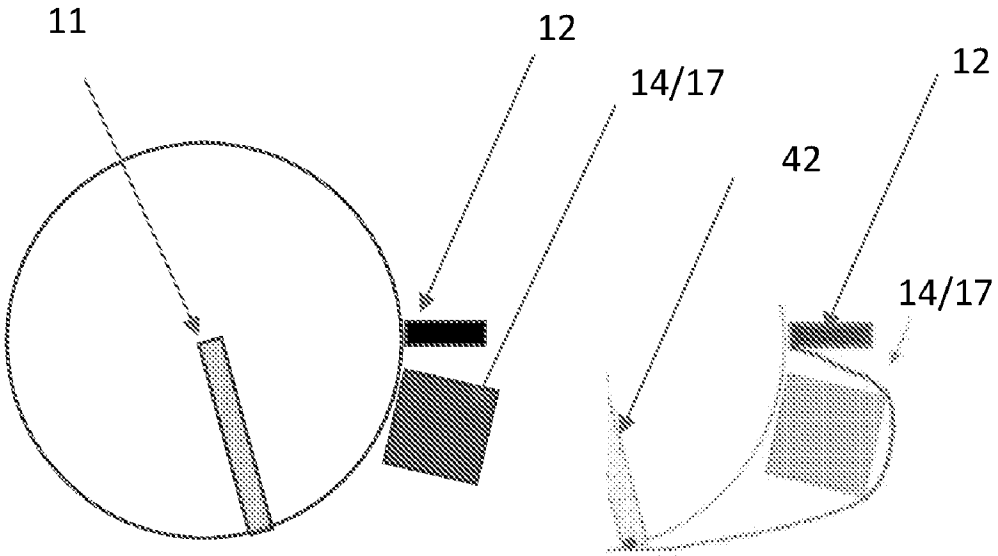
FIG. 18 shows a compartment according to a third embodiment of the invention referred to herein as compartment-collapsible (Comp-C) embodiment.
Figure 19:
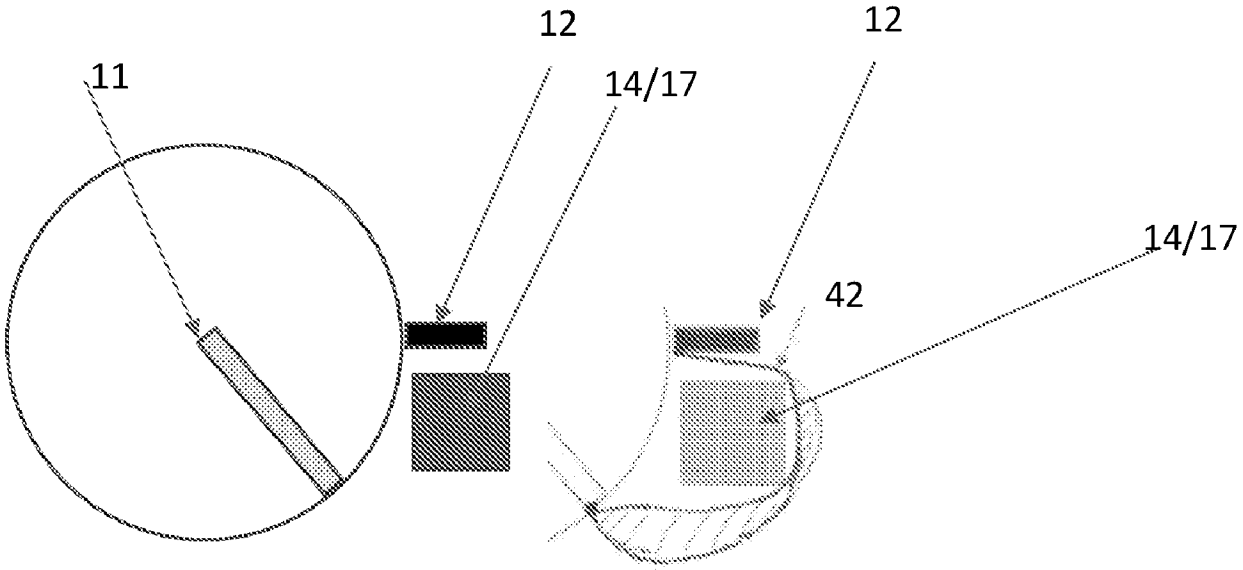
FIGS. 19-20 show the compartment the embodiment of FIG. 19 in different door positions that result in delivery of an object.
Figure 20:
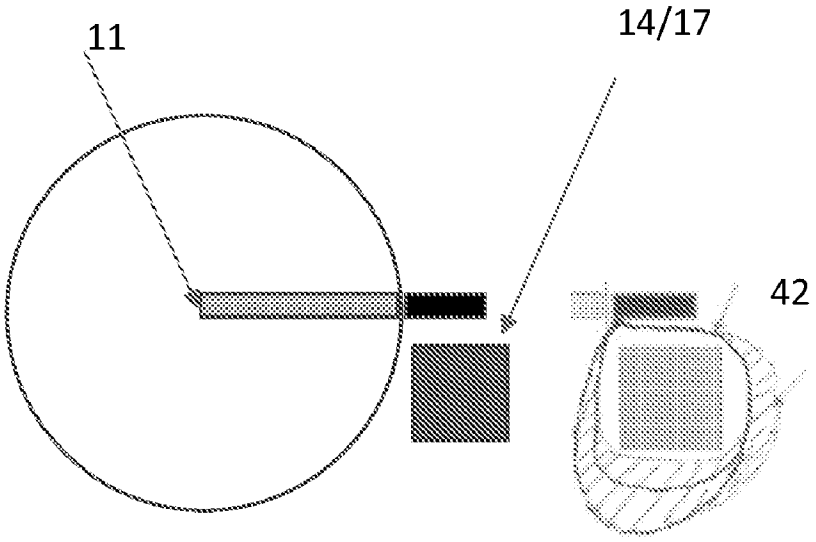

FIG. 18 shows a compartment according to one type of a third embodiment of the invention referred to herein as compartment-collapsible (Comp-C) embodiment with door partially opened. A variety of shapes are possible depending on how the flexible compartment 42 is "shaped" during the delivery process. FIGS. 19 and 20 show the compartment the embodiment of FIG. 19 in different door positions that result in deliver of an object.

Below are examples of delivery process.

Package Delivery

1. The Main Door is opened using Code 2
2. The package is delivered
3. No action takes place to trigger any of the intrusion detection sensors.
4. The main door is closed.

Pet Walking

1. The Main Door is opened using Code 2
2. The pet door is opened using Code 4.
3. The pet is retrieved and the pet door is closed.
4. No action takes place to trigger any of the intrusion detection sensors.
5. The main door is closed.

Pharma Delivery

1. The Main Door is opened using Code 2
2. The pharma container is opened using Code 5.
3. The pharma is placed in the container and its door is closed. 4. No action takes place to trigger any of the intrusion detection sensors. 5. The main door is closed.

Based on the foregoing, a compartment is attached between the door and the door frame that can have three different embodiments, namely:

i. Comp-R: The compartment can be rigid in structure. Two types (Type 1 and Type 2) are described.
ii. Comp-P: The compartment can be made of vertical panels. See the drawings.
iii. Comp-C: The compartment can be collapsible and made with a mesh array that is flexible. This is not shown in any of the drawings.

The compartment can be removed and stored away when not in use. The compartment provides a physical intrusion barrier when they are locked to the door and door-frame. For all types, a locking mechanism exists between the compartment and the door and a locking mechanism exists between the compartment and the door-frame. The compartments provide a visual barrier when in place. The delivery person cannot see inside the house. The compartments are equipped with physical intrusion detection mechanisms. These intrusion mechanisms are "tied into" a central unit (CU). The CU can tie into the central alarm for the home and it can also communicate to various devices (the owner's phone or the system for a monitoring company). An alternate implementation allows each of the sensors to communicate to the home alarm system which can now act as the CU.

The intrusion detection mechanisms consist of sensors that detect the following:

The physical barrier has been breached:

Someone is creating a hole in the barrier.

The compartment is undergoing un-natural shaking.

The breaching can also be detected through cameras.

The compartment is being detached from the door frame or door inappropriately or in an unauthorized fashion. This can be detected by proximity sensors that are breached between the vertical bars and any of FAPU, FAPM, FAPL, DAPU, DAPM, DAPL. The physical intrusion detection mechanisms can be battery powered or powered by a wall-plug. The physical intrusion detection mechanisms (from different parts of the compartments) can communicate to a central unit through wires or through wireless connections.

The following are example of use cases of the invention:

i. A delivery person wants to deliver a package to the home or pick up a package from the home.
ii. The delivery person is given a temporary pass-code which opens the door lock. Alternatively, the home owner is notified that the delivery person is waiting at the door and unlocks the electronic door lock remotely.
iii. This temporary passcode does not open the locks that connect the compartment to the door or the door-frame. It is up to the home-owner to make an exception in case a package is being delivered that can not fit into the compartment.
iv. The home alarm system is temporarily deactivated when the temporary passcode is used. There can be a time limit that can be set for the delivery process (opening of the door to closing it).
v. A person breaks into the home. They would have to bypass the main door and also the compartment (which has intrusion sensors). The presence of the compartment presents an additional barrier for breaking into the home.
vi. A person successfully opens the main door without setting off any alarms and proceeds to try to penetrate through the compartment. The following conditions can be sensed by the compartment sensing systems:

vii. Cutting of the compartment walls or panel.

viii. Unauthorized detachment of the compartment from the door frame or the door.

ix. Bending of the compartment in order to gain access into the home without unlocking the lock that attaches the compartment to the frame or the door. Again, this unauthorized access is detected by proximity sensors between the rigid vertical bars and any of FAPU, FAPM, FAPL, DAPU, DAPM, DAPL.

x. A dog-walking service can get a temporary access key to open the main door. They can also get a temporary access key that allows a pet to walk through a special door in the compartment.

xi. We have identified the emergence of pharmaceutical delivery to the home where there may be a need to access another locked container through CODE-5.

xii. A home owner who wants to come into their home would do the following:

1. Unlock the main door.
2. De-activate the alarm system.
3. Unlock the locks that connect the compartment to the door and/or the frame.
4. A combination of allowed sequences can be envisioned that would be acceptable from a security standpoint.

Mechanically, the compartment attaches to the door frame and the outer edge of the door, where the compartment can be easy to attach through a snap-on action shown in FIGS. 4-6. The compartment can be detached from the door and the door frame through two locks—one that allows the compartment to be detached from the door frame and another that allows the compartment to be detached from the outer edge of the door. The above-mentioned locks can be mechanical (using a conventional metal key) or electronic (using a specific pre-programmed code). Even in this case, the use of proximity detectors can be useful to detect unauthorized access. For the purpose of terminology, we can name these locks Lock-Compartment-Door (LCD) and Lock-Compartment-Frame (LCF). These locks are provided in order to be able to remove the compartment and store it away when it is not needed. LCD and LCF can be unlocked from inside the house and outside the house. The rationale for being able to unlock from inside the house is that one may want to accept a delivery while one is in the house—without having to open the door for the delivery person. The rationale for being able to unlock from outside the house is that in most cases, the resident is away from the house and needs a way to get into the house by removing the compartment in an authorized/acceptable fashion.

Preferably, the compartment can be a rigid object—similar to a cabinet—which has shelves and other amenities to be able to accept different types of products (groceries, boxes, laundry etc.). It can be a foldable rigid object, a collapsible object—which is not rigid. The compartment can have deep pockets for inserting large objects into these pockets. These pockets can be filled with objects from the outside. These objects can then protrude into the house to the depth necessary to accommodate the object (depends on the depth of the pockets being provided.

The collapsible compartment can be opaque—so the delivery person cannot see the inside of the house. This provides privacy and is also a security measure because the delivery person cannot be able to scope the house. The collapsible compartment should be difficult to penetrate physically. For example, it may be constructed out of a mesh of wires that one would have to cut through with wire cutters in order to gain access into the house. This provides a physical barrier against intrusion. We can refer to this mesh of wires as Mesh to prevent Physical Intrusion (MPI) which can be a mesh of wires that can be difficult to cut. The collapsible compartment can be equipped with sensors to detect intrusion. Penetration of the mesh can be detected by having a single wire (Penetration Sensor Wire—PSW) that spans the surface of the compartment (on the inside facing side of the compartment) such that when it is cut, this cut can be sensed because it disrupts current flow through this wire. The PSW is a thin wire that does not provide a physical barrier like the MPI would.

In some arrangements, all types of the compartment can have 3 attach points at the door frame and 3 attach points at the door. For each case, the locks LCD and LCF can be at the middle attach point. The attach points at the door frame can be called the Frame Attach Point—Upper, Frame Attach Point—Middle, Frame Attach Point—Lower (FAPU, FAPM, FAPL). Similarly, the attach points at the door can be called Door Attach Point—Upper, Door Attach Point—Middle, and Door Attach Point—Lower (DAPU, DAPM, DAPL).

For Comp-P and Comp-C, there can be a need to connect the compartment to the Door frame and the Door using rigid vertical bars. For Comp-R, one vertical rigid bar is connected to the frame side of the compartment and the other vertical bar is connected to an accordion door. There can be a rigid bar that connects the compartment to the door at three places (DAPU, DAPM, DAPL). The DAPM can lock the vertical bar to the door through the LCD. In a similar fashion, there can be a rigid bar that connects the compartment to the door frame at three places (FAPU, FAPM, FAPL). The FAPM can lock the vertical bar to the frame through the LCF.

The hardware that is attached to the door frame and the outer edge of the door can be designed in a manner that minimizes the visual impact or physical protrusion.

In other arrangements, the three compartment types can have roller wheels or sliding surfaces to allow the movement of the compartment to adjust as necessary as the door is opened. The roller wheels/sliding surfaces are most pertinent to the rigid compartment type and less so for the foldable and collapsible types. These roller wheels/sliding surfaces can also be used to move the compartment away from the door once the occupant returns to their home, and/or when they do not expect to have any further deliveries.

This rigid compartment has "rails" on the top and the bottom that allow the door to open while preserving a physical barrier between the outside of the door and the inside of the house. The rail track is shown in the drawings.

Accordion Door—Rigid Compartment:

When the door is closed, the rigid compartment can be in the house. The compartment can have an "accordion" door that can close the compartment while it is in the home. This "accordion" door prevents pets from getting into the compartment. It also allows sealing in case the compartment has a refrigeration unit. When the door is opened, then the accordion door opens in tandem with the door (and is attached to the door) and exposes the compartment to the outside. This allows the delivery person to place the packages, groceries, dry-cleaning etc. into the compartment. This accordion door also presents a physical/visual barrier for the delivery person. The compartment can be sized to be the height of the door. This has multiple purposes. It presents a physical barrier that prevents entry of a person into the home. It also increases the total volume within the compartment to allow a broad array of "goods" to be delivered to the home. Where applicable, the rigid compartment and foldable compartment can be taller than the door provided there is no obstruction that prevents the compartments from moving. There can be different sized compartments available (different depths or different widths) depending on the needs of the customer. Each compartment can have specs that state the package size it can accommodate. This applies to all three compartment types.

The compartment can also enable a two-way communication between the owner and the delivery person in case adjustment needs to be made for the goods that have been delivered to the compartment. The delivery person can be given a separate key code that allows the door to open and expose the inside of the compartment. This key code can be a one-time use code so the next delivery person can be given a separate key code. The compartment can be equipped with a variety of sensors (cameras, weight sensors, heat sensors etc.) that can provide further input to the occupant who has received the "goods". The sensors can also provide visibility to the delivery person with respect to how much room is still available in the compartment. Sensors are used for detecting improper access or improper use of the compartments. For example, if the physical barrier is breached, one can envision a sensor element that detects the disruption of current flow in a wire that is embedded in the back of a compartment. If an intruder penetrates the container, the wire is likely to break which can be detected as a physical breach.

Sensors can be attached to the frame and door connection points. These sensors can detect if the compartment is being removed from the door or the frame without permission. These would be in the form of proximity sensors. Sensors can be attached to the compartment to detect unnatural shaking—which may be a precursor to an intrusion. The collection of sensors can communicate with a central unit that aggregates all of the sensed information and sets an alarm based on an algorithm. If the home needs to be accessed by others (such as apartment managers, fire-fighters etc, then such access can be provided).

The above was described for in-home delivery applications. It is possible for other applications to emerge where a one needs to take care of pets in the home. The compartment can be adapted to allow a passageway for pets to exit the house or enter the house in conjunction with an electronic lock that is activated by a person who is standing outside the door. This allows "dog-walkers" to do their job without entering the home. With the advent of online delivery of pharmaceuticals, one can use this compartment (or a locked compartment within this compartment) as a receptor for controlled substances. Only people with the proper access to the compartment within the compartment can receive the medication.

Three types of containers have been described all of which provide a physical barrier and a privacy "screen". In order to lower the cost of this apparatus, one can compromise on the strength of the physical barrier, the level of privacy that is provided, the number and types of sensors and alarm systems. One can have a mix and match of the above to customize to different market segment needs. In addition, the other variable in the above is to allow variations in the aesthetic look of these components.

Monitoring systems can be placed inside the compartment or on the ceiling above the compartment. These monitoring systems can have use cases when the main door is open, and when main door is closed:

a. Visual—Camera system:
   i. Main door open results in monitoring the delivery process. Generate alarms or notifications based on algorithms that detect "improper" behavior.
   ii. Main door closed results in monitoring to see if there is anything of interest in the delivery compartment:
      1. A new package
      2. An intruder
      3. A trapped child or pet
      4. Other suspicious items
b. A system that uses a combination of a visual camera system, an infrared camera system, a motion sensor, a thermal sensor in order to generate items i) and ii) above.
c. A mechanism from inside the compartment that can open the main door:
   i. Intended to release a person who is trapped inside by mistake.
   ii. Can be in the form of a push button on the inside of the compartment
   iii. Can be an algorithm that uses a combination of sensors (camera, thermal, motion, etc.) to extrapolate that a person is trapped and that the main door needs to be opened.
d. A mechanism using the above sensors or input devices to create an alarm:
   i. Alerting the home-owner of an abnormal situation
   ii. Setting off the alarm system and also notifying the alarm company's monitoring services.

A quick release mechanism can allow the compartment to be detached from the main door from inside the house. The purpose of this quick release mechanism is to allow very quick egress by the home's occupants in case of an emergency (and in case the compartment is still attached to the main door). Normally, when the residents are at home, they would not have the compartment connected to the door. This mechanism is envisioned for a fringe case. This can be envisioned as a combination of any of the following:

iii. Something that is the equivalent of a mechanical door handle on the home facing side of the compartment (can be opened from inside the house), such that "opening" this door handle detaches the compartment from the main door.
iv. An electronically activated door handle/lock that performs the same function when activated using a "remote control" or a convenient button.
v. An electronically activated door handle/lock that detaches the compartment from the main door when a smoke detector signal is activated.
vi. A more general implementation of item iii) is that the door handle/lock is unlocked using a combination of various signals:
   1. Smoke detector
   2. Carbon Monoxide detector
   3. Building fire alarm system that has triggered
   4. Other emergency signals that might relate to earthquakes, tsunamis and other natural disasters.
   5. Via remote control (say through a phone app)

An "identity" detector can be used with the invention by use of a fingerprint sensor on the inside of the compartment when a package is delivered. This validates that the right person has delivered the package. The identity of the person who is delivering a package can be part of the "product delivery service", so that when the home-owner orders a home delivery, several things happen:

vii. The delivery is assigned to a specific person.
viii. The identity and fingerprint of this person are stored on a secure server.

ix. The delivery person opens the compartment (through the previously described codes).

x. The delivery person "signs in" using the fingerprint sensor.

xi. The system validates that the fingerprint of the delivery person who delivered the package and that which is stored on the secure server match.

xii. If the two do not match, a set of actions can be taken.

Instead of or in addition to using a code to open the main door for the purpose of delivery, a fingerprint sensor can be made available on the door lock or adjacent to the main door. The following sequence can happen:

xiii. The delivery is assigned to a specific person.

xiv. The identity and fingerprint of this person are stored on a secure server.

xv. The delivery person reaches the home and identifies him or herself through the fingerprint sensor.

xvi. The fingerprint sensor queries the secure server to determine if a delivery had been scheduled by this specific delivery person. The system can check to see that the delivery is made within a pre-determined time period and other sanity checks can be performed.

xvii. If there is a match, then the main door is opened in order to deliver the package into the compartment.

xviii. Upon opening of the door, the secure server is notified. This allows the system to "tally" this as a successfully delivered package. Upon closing of the main door, this can then "reset" the secure server so that no other re-try can be attempted by that particular delivery person.

Besides a fingerprint sensor, any other biometric device can be used (iris scanning, facial recognition, etc.). All modalities (fingerprint, iris scanning, facial recognition) generally take the biometric data and extract a finite number of markers. The process of taking the physical data (fingerprint image, iris scan, facial image) and then converting it to numbers and then comparing it to the data in the secure server can be done at the secure server or it can be done by a processor box in the home.

A master key in the form of an electronic signature can be programmed to open more than one lock. For example, a delivery person can only have a key to open the main door, whereas the home-owner can have an electronic key that opens the main door, and another one that detaches the compartment from the door. Alternatively, the home owner can have a key that is programmed to open both the main door and detach the compartment from the main door.

The invention claimed is:

1. An entry device used for delivery of an object by a person, said entry device being attachable to a door that opens and closes by pivoting relative to a door frame to separate an outer area from an inner area, comprising a compartment having a first side attached to the door and a second side attached to the door frame, wherein the compartment has an open front surface that faces the outer area when the door is opened for receiving the object from the delivery person and a closed back surface that moves to fully enclose the object within the inner area when the door is closed;

at least one first attachment point disposed along the first side that attaches the compartment to the door, at least one second attachment point disposed along the second side that attaches the compartment to the door frame, wherein upon opening of the door, the compartment is configured to allow receiving the object from the outer area and prevent entry by the person from the outer area into the inner area;

a first lock disposed along the first side configured to lock to the door, wherein the first lock can be unlocked from the inner area and outer area; and a second lock disposed along the second side configured to lock to the door frame, wherein the second lock can be unlocked from the inner area and outer area.

2. The entry device of claim 1, further comprising a controller that is responsive to unlocking the first lock or the second lock for generating an alarm.

3. The entry device of claim 1, wherein the compartment has a portion made of flexible material that flexes when the door is opened or closed.

4. The entry device of claim 1, wherein the first lock or the second lock comprises a mechanical lock.

5. The entry device of claim 1, wherein the first lock comprises a first electronic lock having a first proximity sensor that detects detachment of the compartment from the door.

6. The entry device of claim 5, wherein the second lock comprises a second electronic lock having a second proximity sensor that detects detachment of the compartment from the door frame.

7. The entry device of claim 1, wherein an identity detector comprising a biometric sensor is used to identify the person when the object is delivered.

8. The entry device of claim 1, wherein identity and fingerprint of the person are stored on a server.

9. The entry device of claim 8, wherein the server is queried to determine if a delivery had been scheduled by the person.

10. The entry device of claim 8, wherein the server is queried to determine if the delivery is made within a pre-determined time.

11. The entry device of claim 1, further including a camera for monitoring a delivery process.

12. The entry device of claim 1, further including an interface for entry of a key in a form of an electronic signature, which can be programmed to open the first or the second lock.

* * * * *